US009091951B2

(12) United States Patent
Nonaka et al.

(10) Patent No.: US 9,091,951 B2
(45) Date of Patent: Jul. 28, 2015

(54) ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masaki Nonaka, Suntou-gun (JP); Hideaki Nagasaka, Suntou-gun (JP); Masato Tanaka, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/688,704

(22) Filed: Nov. 29, 2012

(65) Prior Publication Data

US 2013/0137024 A1 May 30, 2013

(30) Foreign Application Priority Data

Nov. 30, 2011 (JP) ..... 2011-262125
Nov. 6, 2012 (JP) ..... 2012-244528

(51) Int. Cl.

| | |
|---|---|
| ***G03G 5/147*** | (2006.01) |
| ***G03G 5/10*** | (2006.01) |
| ***G03G 5/06*** | (2006.01) |

(Continued)

(52) U.S. Cl.

CPC ..... *G03G 5/14734* (2013.01); *G03G 5/051* (2013.01); *G03G 5/0546* (2013.01); *G03G 5/0589* (2013.01); *G03G 5/0592* (2013.01); *G03G 5/0596* (2013.01); *G03G 5/0605* (2013.01); *G03G 5/0614* (2013.01); *G03G 5/071* (2013.01); *G03G 5/105* (2013.01); *G03G 5/14717* (2013.01); *G03G 5/14739* (2013.01); *G03G 5/14786* (2013.01); *G03G 5/14791* (2013.01); *G03G 5/14795* (2013.01)

(58) Field of Classification Search

CPC ..... G03G 5/0546; G03G 5/0605; G03G 5/14739; G03G 5/14734
USPC ..... 430/58.7, 66, 58.25, 58.05, 58.35, 58.2
See application file for complete search history.

(56) References Cited

U.S. PATENT DOCUMENTS 5,232,801 A * 8/1993 Rule et al. ..... 430/58.2
8,735,032 B2 * 5/2014 Nonaka et al. ..... 430/66

(Continued)

FOREIGN PATENT DOCUMENTS

CN 1577114 A 2/2005
CN 101762995 A 6/2010

(Continued)

OTHER PUBLICATIONS

English language machine translation of JP 2007-086522 (Apr. 2007).*

(Continued)

*Primary Examiner* — Christopher Rodee
(74) *Attorney, Agent, or Firm* — Canon U.S.A. Inc., IP Division

(57) ABSTRACT

In an electrophotographic photosensitive member having a surface layer containing a polymer obtainable by polymerization of a compound having a chain-polymerizable functional group, the compound having a chain-polymerizable functional group includes a compound represented by formula (1).

11 Claims, 2 Drawing Sheets

(51) Int. Cl.
*G03G 5/05* (2006.01)
*G03G 5/07* (2006.01)

(56) References Cited

U.S. PATENT DOCUMENTS

| | | | | |
|---|---|---|---|---|
| 2011/0159419 | A1 | 6/2011 | Iwamoto | |
| 2012/0202146 | A1* | 8/2012 | Yamada et al. | 430/56 |
| 2012/0301177 | A1* | 11/2012 | Tanaka et al. | 399/111 |
| 2012/0301178 | A1* | 11/2012 | Nonaka et al. | 430/133 |

FOREIGN PATENT DOCUMENTS

| | | | | |
|---|---|---|---|---|
| CN | 102799085 | A | * | 11/2012 |
| EP | 2219080 | A2 | | 8/2010 |
| JP | 2005-062302 | A | | 3/2005 |
| JP | 2007086522 | A | * | 4/2007 |

OTHER PUBLICATIONS

English language machine translation of JP 2005-062302 (Mar. 2005).*

* cited by examiner

ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a method of producing the electrophotographic photosensitive member, a process cartridge, and an electrophotographic apparatus.

2. Description of the Related Art

In recent years, for the purpose of extending the life and improving image quality of an electrophotographic photosensitive member and increasing the processing speed of an electrophotographic apparatus, it has been desired to improve the mechanical durability (abrasion resistance) of an organic electrophotographic photosensitive member containing an organic photoconductive substance (hereinafter referred to as an "electrophotographic photosensitive member"). In order to improve the mechanical durability, according to one technique, a surface layer of an electrophotographic photosensitive member contains a polymer produced by polymerization of a compound having a polymerizable functional group.

Japanese Patent Laid-Open No. 2000-066425 discloses a technique of improving the abrasion resistance and electric potential stability of an electrophotographic photosensitive member by adding a polymer obtained by polymerizing a charge transporting compound having two or more chain-polymerizable functional groups to the surface layer of the electrophotographic photosensitive member. Japanese Patent Laid-Open No. 2010-156835 discloses a technique of improving the polymerizability of a charge transporting compound having a chain-polymerizable functional group (methacryloyloxy group) by adding a polymer obtained by polymerizing an electron transporting compound having two or more methacryloyloxy groups to the surface layer.

However, if a charge transporting compound having two or more chain-polymerizable functional groups is used, the charge transporting structure is easily distorted in chain polymerization. As a result, high electric potential stability is sometimes not achieved. Accordingly, Japanese Patent Laid-Open No. 2007-241140 discloses a technique of adding, to the surface layer, a polymer obtained by polymerizing a composition including a charge transporting compound having a single chain-polymerizable functional group and a compound that has three or more chain-polymerizable functional groups and that does not have a charge transporting structure. Japanese Patent Laid-Open No. 2009-015306 discloses a technique of achieving high electric potential stability by using a charge transporting compound which has a single chain-polymerizable functional group and in which an alkylene group is inserted between the chain-polymerizable functional group and a charge transporting structure.

However, the following has been found from studies conducted by the inventors of the present invention. That is, in the charge transporting compound having a single chain-polymerizable functional group disclosed in Japanese Patent Laid-Open Nos. 2007-241140 and 2009-015306, the ratio of a chain-polymerizable functional group that contributes to a chain polymerization reaction in one molecule is low, and the probability that a polymerization reaction does not proceed is higher in the charge transporting compound having a single chain-polymerizable functional group than in a charge transporting compound having two or more chain-polymerizable functional groups. Therefore, the residual potential tends to increase.

SUMMARY OF THE INVENTION

The present invention provides an electrophotographic photosensitive member having a surface layer containing a polymer obtainable by polymerization of a compound having a chain-polymerizable functional group. In the electrophotographic photosensitive member, the residual potential is significantly reduced. The present invention also provides a method of producing the electrophotographic photosensitive member. The present invention also provides a process cartridge and an electrophotographic apparatus each including the electrophotographic photosensitive member.

These can be achieved by the present invention described below.

In an aspect of the present invention, an electrophotographic photosensitive member includes a support and a photosensitive layer formed on the support, wherein a surface layer of the electrophotographic photosensitive member includes a polymer obtainable by polymerization of a compound represented by the following formula (1).

(1)

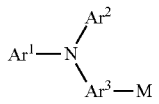

(M)

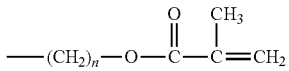

In the formula (1), $Ar^1$ and $Ar^2$ each independently represents a substituted phenyl group. $Ar^3$ represents an unsubstituted or substituted phenylene group. M is a group represented by formula (M) above and, in the formula (M), n represents 3 or 4. A substituent group of the substituted phenyl group and a substituent group of the substituted phenylene group are each independently a methyl group, an ethyl group, a n-propyl group, a methoxy group, an ethoxy group, or a propoxy group.

In another aspect of the present invention, a method of producing the electrophotographic photosensitive member described above includes the following steps of forming a coat for the surface layer by using a surface layer coating solution containing the compound represented by the formula (1) and forming the surface layer by polymerization of the compound represented by the formula (1) in the coat.

In another aspect of the present invention, a process cartridge detachably attachable to a main body of an electrophotographic apparatus integrally supports the electrophotographic photosensitive member and at least one device selected from the group consisting of a charging device, a developing device, a transferring device, and a cleaning device.

In another aspect of the present invention, an electrophotographic apparatus includes the electrophotographic photosensitive member, a charging device, an exposure device, a developing device, and a transferring device.

The present invention can provide an electrophotographic photosensitive member having a surface layer containing a polymer obtainable by polymerization of a compound having a chain-polymerizable functional group. In the electrophotographic photosensitive member, the residual potential is significantly reduced. The present invention can also provide a method for producing the electrophotographic photosensitive member. The present invention can also provide a process cartridge and an electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1A:
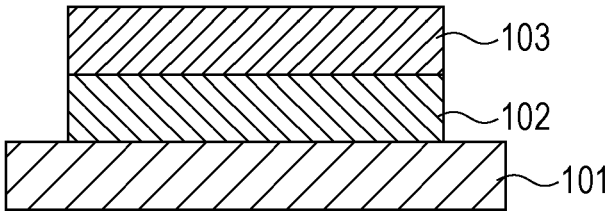
FIGS. 1A and 1B are schematic views each showing an example of a layer structure of an electrophotographic photosensitive member according to an embodiment of the present invention.

In an embodiment of the present invention, a surface layer of an electrophotographic photosensitive member includes a polymer obtainable by polymerization of the compound represented by the formula (1).

The inventors of the present invention assume the reason why the electrophotographic photosensitive member according to an embodiment of the present invention is excellent in terms of reduction in a residual potential to be as follows.

The compound represented by the formula (1) is a kind of charge transporting compound having a single chain-polymerizable functional group. The charge transporting compound having a single chain-polymerizable functional group has a relatively high ratio of a charge transporting structure to the chain-polymerizable functional group and tends to provide a stable molecular orientation due to the polymerization with a single chain-polymerizable functional group. Therefore, it can be expected that the polymer of the compound exhibits high electric potential stability.

However, the probability that a polymerization reaction does not proceed is higher in the charge transporting compound having a single chain-polymerizable functional group than in a charge transporting compound having two or more chain-polymerizable functional groups. Therefore, it is believed that uneven polymerization easily occurs in the film depth direction and consequently the residual potential tends to increase. Furthermore, if the degree of freedom of a charge transporting structure is excessively large, microaggregation is easily caused between charge transporting structures. It is also believed that the residual potential increases in a portion in which the density of the charge transporting structures is low after polymerization.

As a result of studies conducted by the inventors of the present invention, it has been found from Japanese Patent Laid-Open No. 2010-156835 that, when a charge transporting compound having a single methacryloyloxy group is used, the polymerization reaction rapidly proceeds and the polymerization efficiency is relatively increased compared with the case where a charge transporting compound having an acryloyloxy group is used. However, it has been found that, because of the increase in the polymerization reaction rate by a methacryloyloxy group, the charge transporting structure causes steric hindrance depending on the size and functional group of the charge transporting structure and thus the polymerization efficiency is prevented from being sufficiently increased or microaggregation is easily caused between the charge transporting structures. It has also been found that the residual potential is not sufficiently reduced only by inserting an alkylene group between the charge transporting structure and the methacryloyloxy group using the technique disclosed in Japanese Patent Laid-Open No. 2009-015306.

As a result of thorough studies conducted by the inventors of the present invention, it has been found that, to reduce the residual potential, an alkylene group between the charge transporting structure and the methacryloyloxy group needs to have an appropriate length in accordance with the skeleton and size of the charge transporting structure. It has also been found that an appropriate substituent group needs to be provided to suppress microaggregation between the charge transporting structures and a decrease in polymerization efficiency.

A surface layer of the electrophotographic photosensitive member according to an embodiment of the present invention includes a polymer obtainable by polymerization of a compound represented by the following formula (1).

(1)

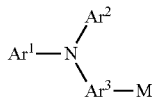

(M)

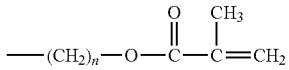

In the formula (1), $Ar^1$ and $Ar^2$ each independently represents a substituted phenyl group. Examples of a substituent group of the substituted phenyl group include a methyl group, an ethyl group, a n-propyl group, a methoxy group, an ethoxy group, and a propoxy group. If the substituent group of the substituted phenyl group is a substituent group other than the above-described substituent groups, such a substituent group causes steric hindrance during a polymerization reaction and the polymerization reaction does not sufficiently proceed. When $Ar^1$ and $Ar^2$ each independently represents an unsubstituted phenyl group, the polymerization efficiency does not decrease, but microaggregation between triphenylamine structures is caused and thus the residual potential is easily increased. $Ar^3$ represents an unsubstituted or substituted phenylene group. Examples of a substituent group of the substituted phenylene group include a methyl group, an ethyl group, a n-propyl group, a methoxy group, an ethoxy group, and a propoxy group. If the substituent group of the substituted phenylene group is a substituent group other than the above-described substituent groups, such a substituent group causes steric hindrance during a polymerization reaction and the polymerization efficiency is decreased.

In the formula (1), M is a group represented by the above formula (M) and, in the formula (M), n represents 3 or 4. When n is 0 or more and 2 or less, the length of an alkylene group is not sufficiently large relative to a triphenylamine structure. Therefore, the charge transporting structure causes steric hindrance due to the increase in the polymerization reaction rate by a methacryloyloxy group and the polymerization efficiency is decreased. As a result, uneven polymerization easily occurs in the film depth direction. When n is an integer number of 5 or more, the degree of freedom of the triphenylamine structure is excessively increased. Therefore, microaggregation between the triphenylamine structures is easily caused and the residual potential is easily increased.

Furthermore, if an oxygen atom or a phenylene group is present between the alkylene group and the methacryloyloxy group, cleavage is caused from such an oxygen atom or phenylene group during the polymerization reaction. This easily causes a decrease in the polymerization efficiency and micro-aggregation between triphenylamine structures, and thus the residual potential is easily increased.

When the surface layer of the electrophotographic photosensitive member is formed, the compounds represented by the formula (1) may be used alone or in combination of two or more.

The compound represented by the formula (1) can be synthesized by, for example, a synthesis method disclosed in Japanese Patent Laid-Open No. 2005-227761. Specific examples of the compounds represented by the formula (1) are described below, but the present invention is not limited thereto. M3 and M4 in the example compounds are each a methacryloyloxy group, which is a specific example of the group represented by the formula (M). Specific structures are described below.

M3

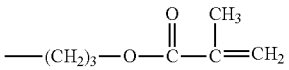

M4

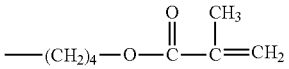

(1A-1)

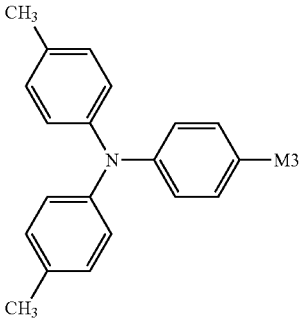

(1A-2)

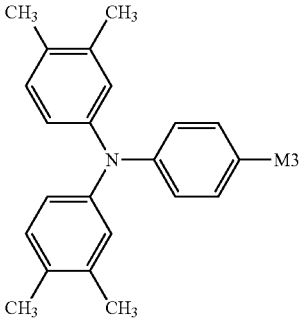

(1A-3)

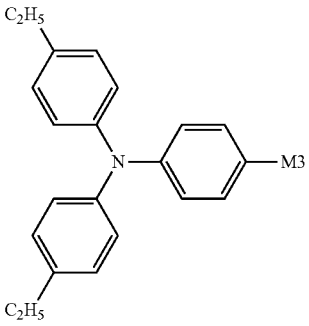

-continued (1A-4)

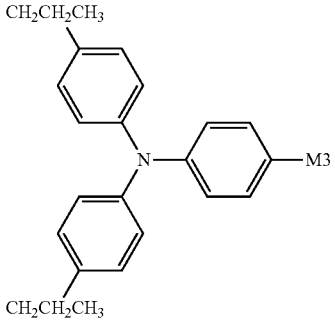

(1A-5)

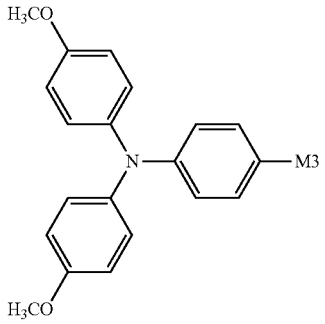

(1A-6)

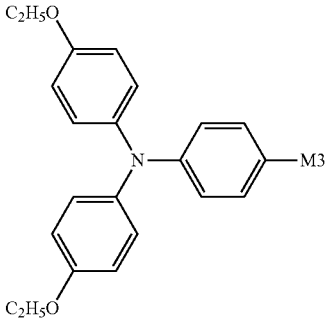

(1A-7)

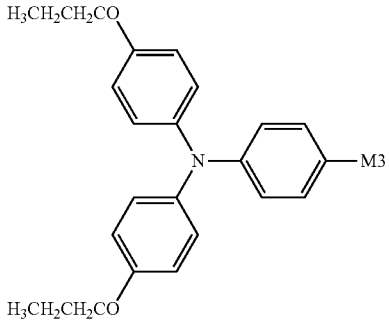

(1A-8)

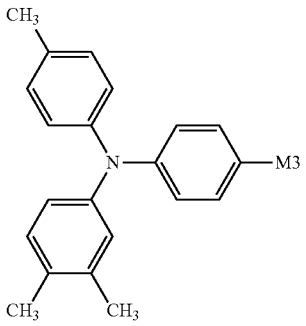

-continued
(1A-9)
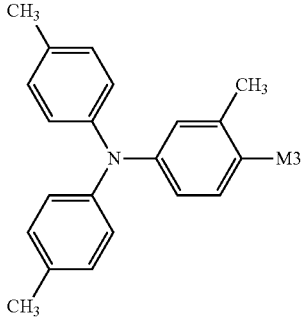
(1A-10)
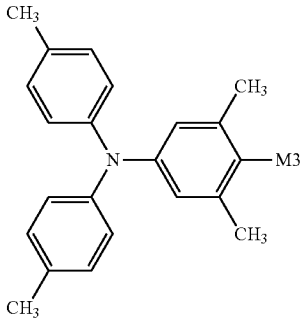
(1A-11)
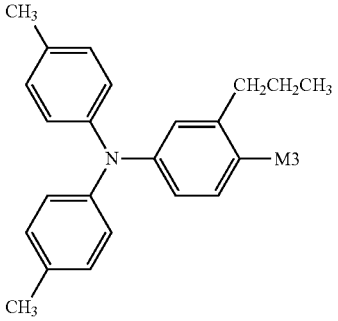
(1A-12)
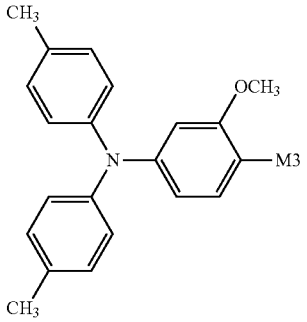
(1B-1)
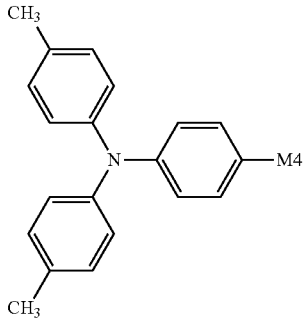
-continued
(1B-2)
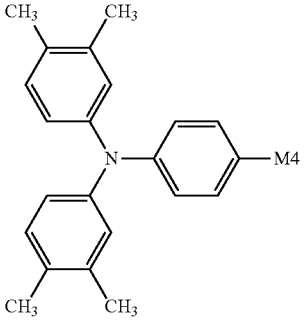
(1B-3)
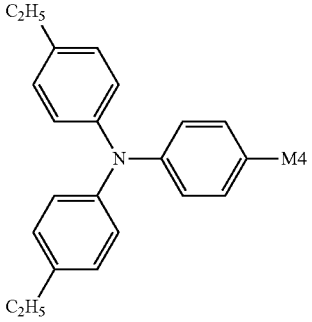
(1B-4)
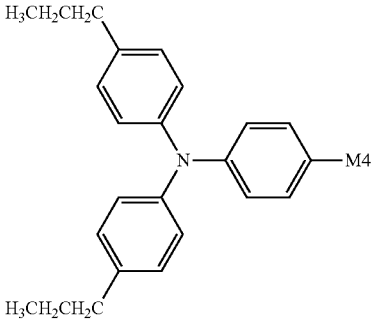
(1B-5)
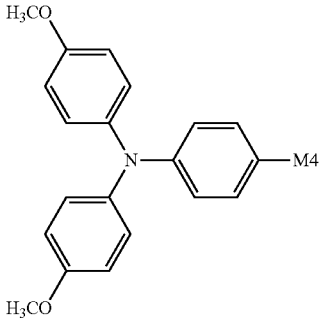
(1B-6)
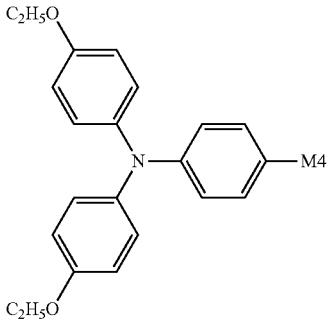

-continued (1B-7)

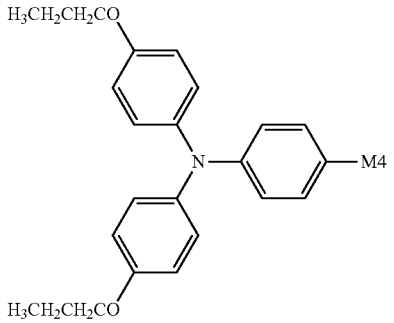

(1B-8)

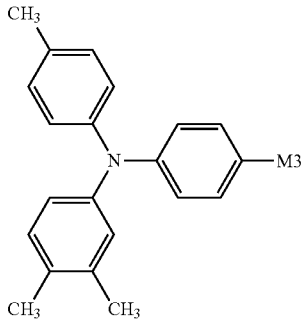

(1B-9)

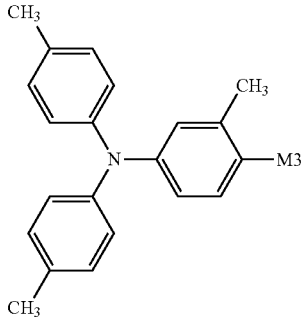

(1B-10)

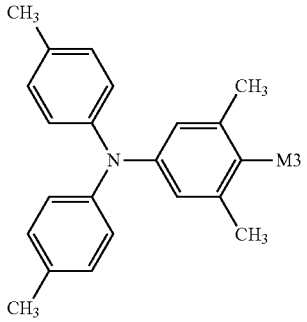

(1B-11)

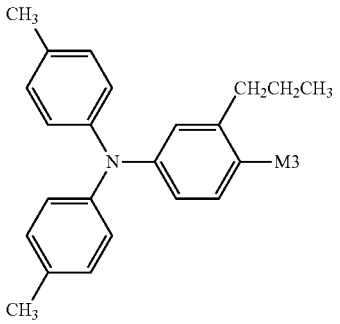

-continued (1B-12)

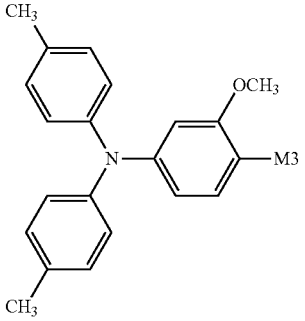

The photosensitive layer may be a monolayer photosensitive layer that contains a charge generating substance and a charge transporting substance or a multilayer (function-separated) photosensitive layer that includes a charge generating layer containing a charge generating substance and a charge transporting layer containing a charge transporting substance. The electrophotographic photosensitive member according to an embodiment of the present invention can have a multilayer photosensitive layer. The charge transporting layer may also have a multilayer structure. The charge transporting layer may be covered with a protective layer.

Figure 1B:
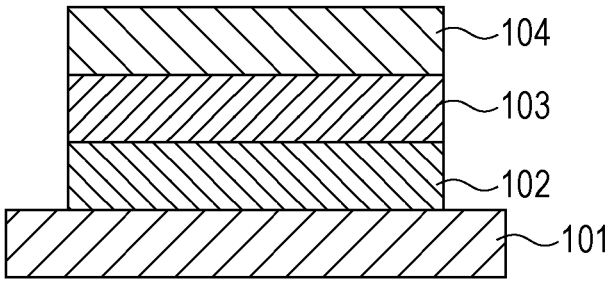

FIGS. 1A and 1B are schematic views each showing an example of the layer structure of the electrophotographic photosensitive member according to an embodiment of the present invention. The layer structures in FIGS. 1A and 1B include a support 101, a charge generating layer 102, a charge transporting layer 103, and a protective layer (second charge transporting layer) 104. If necessary, an undercoat layer (intermediate layer) may be disposed between the support 101 and the charge generating layer 102. The term "surface layer" of the electrophotographic photosensitive member according to an embodiment of the present invention means an outermost layer. For example, in an electrophotographic photosensitive member having the layer structure shown in FIG. 1A, the surface layer of the electrophotographic photosensitive member is the charge transporting layer 103. In an electrophotographic photosensitive member having the layer structure shown in FIG. 1B, the surface layer of the electrophotographic photosensitive member is the protective layer 104.

The electrophotographic photosensitive member according to an embodiment of the present invention can be produced by a method that includes forming a coat using a surface layer coating solution containing the compound represented by the formula (1) and forming a surface layer by polymerization (chain polymerization) of the compound represented by the formula (1) in the coat.

The polymer contained in the surface layer may be obtainable by polymerization of a composition including the compound represented by the formula (1) and a compound which includes two or more methacryloyloxy groups and does not include a charge transporting structure. To suppress the microaggregation between triphenylamine structures of the compound represented by the formula (1) and reduce the residual potential, a compound (adamantane compound) represented by formula (A) below can be used. To suppress the accumulation of the residual potential caused by a discharge product, a compound represented by formula (B) below and a compound (urea compound) represented by formula (C) below can be used. The adamantane compound and the urea compound can each have two methacryloyloxy groups because the polymerization efficiency of a triphenylamine structure in the formula (1), which exhibits charge transportability, is increased.

(A)

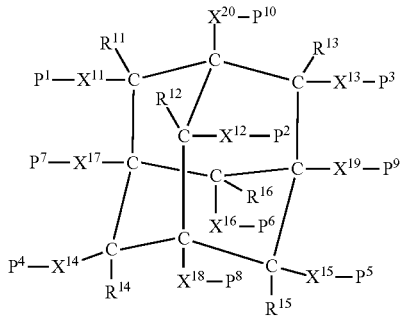

In the formula (A), $R^{11}$ to $R^{16}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, or a bromine atom. $X^{11}$ to $X^{20}$ each independently represents a single bond or an alkylene group. $P^1$ to $P^{10}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, a bromine atom, or a methacryloyloxy group. When $X^{11}$ is a single bond, $P^1$ and $R^{11}$ may combine to form an oxo group (=O). When $X^{12}$ is a single bond, $P^2$ and $R^{12}$ may combine to form an oxo group (=O). When $X^{13}$ is a single bond, $P^3$ and $R^{13}$ may combine to form an oxo group (=O). When $X^{14}$ is a single bond, $P^4$ and $R^{14}$ may combine to form an oxo group (=O). When $X^{15}$ is a single bond, $P^5$ and $R^{15}$ may combine to form an oxo group (=O). When $X^{16}$ is a single bond, $P^6$ and $R^{16}$ may combine to form an oxo group (=O). At least one of $P^1$ to $P^{10}$ is a methacryloyloxy group. When $P^1$ is a methacryloyloxy group, $R^{11}$ is a hydrogen atom. When $P^2$ is a methacryloyloxy group, $R^{12}$ is a hydrogen atom. When $P^3$ is a methacryloyloxy group, $R^{13}$ is a hydrogen atom. When $P^4$ is a methacryloyloxy group, $R^{14}$ is a hydrogen atom. When $P^5$ is a methacryloyloxy group, $R^{15}$ is a hydrogen atom. When $P^6$ is a methacryloyloxy group, $R^{16}$ is a hydrogen atom.

(B)

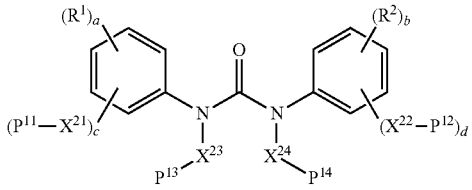

(C)

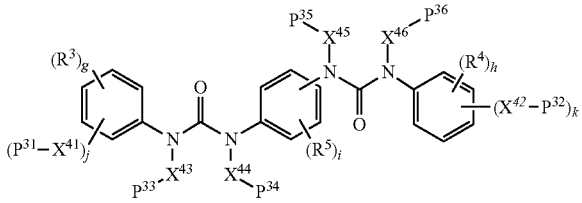

In the formulae (B) and (C), $R^1$ to $R^5$ each independently represents a methyl group, an ethyl group, a n-propyl group, a methoxymethyl group, a trifluoromethyl group, a trichloromethyl group, a methoxy group, an ethoxy group, a propoxy group, a methoxymethoxy group, a trifluoromethoxy group, a trichloromethoxy group, a dimethylamimo group, or a fluorine atom. $X^{21}$ to $X^{24}$ and $X^{41}$ to $X^{46}$ each independently represents an alkylene group. $P^{11}$ to $P^{14}$ and $P^{31}$ to $P^{36}$ each independently represents a hydrogen atom or a methacryloyloxy group. At least two of $P^{11}$ to $P^{14}$ are methacryloyloxy groups. At least two of $P^{31}$ to $P^{36}$ are methacryloyloxy groups. Furthermore, a, b, g, and h each independently represents an integer number selected from 0 to 5, i represents an integer number selected from 0 to 4, and c, d, j, and k each independently represents 0 or 1.

The surface layer of the electrophotographic photosensitive member according to an embodiment of the present invention may contain various additive agents. Examples of the additive agents include antidegradants such as antioxidants and ultraviolet absorbers, lubricants such as polytetrafluoroethylene (PTFE) resin fine particles and fluorocarbons, and polymerization control agents such as polymerization initiators and polymerization terminators. The surface layer may contain a compound (urea compound) represented by the following formula (D), (E), or (F), which can suppress the accumulation of residual potential caused by a discharge product.

(D)

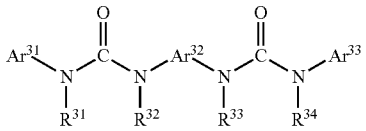

(E)

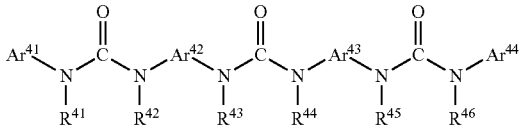

(F)

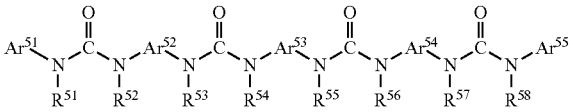

In the formulae (D), (E) and (F), $R^{31}$ to $R^{34}$, $R^{41}$ to $R^{46}$, and $R^{51}$ to $R^{58}$ each independently represents an alkyl group. $Ar^{32}$, $Ar^{42}$ and $Ar^{43}$, and $Ar^{52}$ to $Ar^{54}$ each independently represents an unsubstituted or substituted arylene group. A substituent group of the substituted arylene group is an alkyl group, an alkoxy-substituted alkyl group, a halogen-substituted alkyl group, an alkoxy group, an alkoxy-substituted alkoxy group, a halogen-substituted alkoxy group, or a halogen atom. $Ar^{31}$, $Ar^{33}$, $Ar^{41}$, $Ar^{44}$, $Ar^{51}$, and $Ar^{55}$ each independently represents an unsubstituted or substituted aryl group or a condensed ring. A substituent group of the substituted aryl group is a carboxyl group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

The surface layer may contain at least one compound selected from the group consisting of a compound represented by the following formula (G) and a compound represented by the following formula (H). These compounds can deactivate a large number of radicals derived from a methacryloyloxy group of the compound represented by the formula (1) and control the polymerization reaction between the methacryloyloxy groups. Consequently, uneven polymerization in the film depth direction is suppressed and thus the residual potential can be reduced. From the viewpoint of controlling the polymerization reaction, the amounts of the compound represented by the following formula (G) and the compound represented by the following formula (H) are each 5 ppm or more and 1500 ppm or less, preferably 5 ppm or more and 100 ppm or less, and more preferably 10 ppm or more and 90 ppm or less of the total mass of the polymer.

(G)

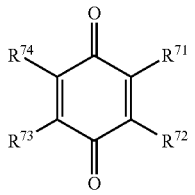

(H)

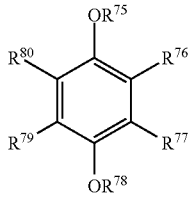

In the formulae (G) and (H), $R^{71}$ to $R^{74}$, $R^{76}$, $R^{77}$, $R^{79}$, and $R^{80}$ each independently represents a hydrogen atom, a hydroxy group, an unsubstituted or substituted alkyl group, an unsubstituted or substituted aryl group, or an unsubstituted or substituted alkoxy group. At least one of $R^{71}$ and $R^{74}$, at least one of $R^{72}$ and $R^{73}$, at least one of $R^{76}$ and $R^{80}$, and at least one of $R^{77}$ and $R^{79}$ each independently represents a hydrogen atom, a methyl group, or a hydroxy group. $R^{75}$ and $R^{78}$ each independently represents a hydrogen atom, an unsubstituted or substituted alkyl group, or an unsubstituted or substituted aryl group. At least one of $R^{75}$ and $R^{78}$ is a hydrogen atom. A substituent group of the substituted alkyl group, a substituent group of the substituted aryl group, and a substituent group of the substituted alkoxy group are each a carboxy group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

Examples of the compound represented by the formula (G) include benzoquinones such as p-benzoquinone, 2,6-dimethyl-p-benzoquinone, methyl-p-benzoquinone, and tert-butyl-p-benzoquinone. Examples of the compound represented by the formula (H) include hydroquinone monomethyl ether, hydroquinone, and 2,5-bis(tert-butyl)-1,4-benzenediol.

In the formula (H), $R^{75}$ may be a hydrogen atom, and $R^{78}$ may be a substituted or unsubstituted alkyl group or a substituted or unsubstituted aryl group. Furthermore, $R^{78}$ may be a methyl group and, in particular, may be hydroquinone monomethyl ether.

In the compounds represented by the formulae (A) to (H), examples of the alkyl group include a methyl group, an ethyl group, and a n-propyl group. Examples of the alkylene group include a methylene group, an ethylene group, and a n-propylene group. Examples of the alkoxy-substituted alkyl group include a methoxymethyl group and an ethoxymethyl group. Examples of the halogen-substituted alkyl group include a trifluoromethyl group and a trichloromethyl group. Examples of the alkoxy group include a methoxy group and an ethoxy group. Examples of the alkoxy-substituted alkoxy group include a methoxymethoxy group and an ethoxymethoxy group. Examples of the halogen-substituted alkoxy group include a trifluoromethoxy group and a trichloromethoxy group. Examples of the halogen atom include a fluorine atom, a chlorine atom, and a bromine atom. Examples of the dialkylamino group include a dimethylamino group and a diethylamino group.

Examples of the solvent used for the surface layer coating solution include alcohol solvents such as methanol, ethanol, and propanol; ketone solvents such as acetone, methyl ethyl ketone, and cyclohexanone; ester solvents such as ethyl acetate and butyl acetate; ether solvents such as tetrahydrofuran and dioxane; halogen solvents such as 1,1,2,2,3,3,4-heptafluorocyclopentane, dichloromethane, dichloroethane, and chlorobenzene; aromatic solvents such as benzene, toluene, and xylene; and cellosolve solvents such as methyl cellosolve and ethyl cellosolve. These solvents may be used alone or in combination of two or more.

The structure of the electrophotographic photosensitive member according to an embodiment of the present invention will be described below.

Support

A support for use in the electrophotographic photosensitive member according to an embodiment of the present invention is a support having electrical conductivity (electroconductive support), for example, made of aluminum, an aluminum alloy, or stainless steel. An aluminum or aluminum alloy support may be an ED tube, an EI tube, or a support manufactured by cutting, electrochemical mechanical polishing, or wet or dry honing of the ED or EI tube. A metal support or a resin support may be covered with a thin film made of an electroconductive material such as aluminum, an aluminum alloy, or an indium oxide-tin oxide alloy. The surface of the support may be subjected to cutting, surface roughening, or alumite treatment.

The support for use in the electrophotographic photosensitive member may be a support obtained by impregnating a resin or the like with electroconductive particles such as carbon black, tin oxide particles, titanium oxide particles, or silver particles. The support may also be a plastic containing an electroconductive binder resin.

In the electrophotographic photosensitive member according to an embodiment of the present invention, an electroconductive layer containing electroconductive particles and a resin may be formed on the support. In a method for forming an electroconductive layer containing electroconductive particles and a resin on the support, the electroconductive layer contains a powder containing electroconductive particles. Examples of the electroconductive particles include carbon black; acetylene black; powders of metals such as aluminum, nickel, iron, nichrome, copper, zinc, and silver; and powders of metal oxides such as electroconductive tin oxide and indium-tin oxide (ITO).

Examples of the resin for use in the electroconductive layer include acrylic resin, alkyd resin, epoxy resin, phenolic resin, butyral resin, polyacetal resin, polyurethane, polyester, polycarbonate, and melamine resin.

Examples of the solvent for use in an electroconductive layer coating solution include ether solvents, alcohol solvents, ketone solvents, and aromatic hydrocarbon solvents. The thickness of the electroconductive layer is preferably 0.2 μm or more and 40 μm or less and more preferably 5 μm or more and 40 μm or less.

The electrophotographic photosensitive member according to an embodiment of the present invention may include an undercoat layer between the support or the electroconductive layer and the photosensitive layer. The undercoat layer can be formed by applying an undercoat layer coating solution containing a resin onto the support or the electroconductive layer and drying or hardening the undercoat layer coating solution.

Examples of the resin for use in the undercoat layer include polyacrylic acid, methylcellulose, ethylcellulose, polyamide resin, polyimide resin, polyamide-imide resin, polyamic acid resin, melamine resin, epoxy resin, and polyurethane resin. The undercoat layer can contain the electroconductive particles described above.

Examples of the solvent for use in the undercoat layer coating solution include ether solvents, alcohol solvents, ketone solvents, and aromatic hydrocarbon solvents. The thickness of the undercoat layer is preferably 0.05 μm or more and 40 μm or less and more preferably 0.4 to 20 μm. The undercoat layer may contain semiconductive particles, an electron transporting substance, or an electron accepting substance.

Photosensitive Layer

In the electrophotographic photosensitive member according to an embodiment of the present invention, a photosensitive layer (charge generating layer, charge transporting layer) is formed on the support, the electroconductive layer, or the undercoat layer.

Examples of a charge generating substance for use in the electrophotographic photosensitive member according to an embodiment of the present invention include pyrylium, thiapyrylium dyes, phthalocyanine compounds, anthanthrone pigments, dibenzpyrenequinone pigments, pyranthrone pigments, azo pigments, indigo pigments, quinacridone pigments, and quinocyanine pigments. The charge generating substance can be gallium phthalocyanine. Hydroxy gallium phthalocyanine crystals having strong peaks at Bragg angles 2θ of 7.4°±0.3° and 28.2°±0.3° in CuKα characteristic X-ray diffraction can be particularly used in terms of high sensitivity.

The charge generating layer can be formed by applying a charge generating layer coating solution and drying the charge generating layer coating solution. The charge generating layer coating solution is prepared by dispersing a charge generating substance together with a binder resin and a solvent. The charge generating layer may also be an evaporated film made of a charge generating substance.

Examples of a binder resin for use in a charge generating layer of a multilayer photosensitive layer according to an embodiment of the present invention include polycarbonate resin, polyester resin, butyral resin, polyvinyl acetal resin, acrylic resin, vinyl acetate resin, and urea resin. The binder resin can be particularly a butyral resin. These resins can be used alone or in combination of two or more as a mixture or a copolymer.

In the charge generating layer, the content of the binder resin can be 0.3 parts or more by mass and 4 parts or less by mass relative to 1 part by mass of the charge generating substance. The dispersion may be performed with a homogenizer, ultrasonic waves, a ball mill, a sand mill, an attritor, or a roll mill.

Examples of a solvent for use in the charge generating layer coating solution include alcohol solvents, sulfoxide solvents, ketone solvents, ether solvents, ester solvents, and aromatic hydrocarbon solvents. The thickness of the charge generating layer is preferably 0.01 μm or more and 5 μm or less and more preferably 0.1 μm or more and 1 μm or less. The charge generating layer may optionally contain various additive agents such as a sensitizer, an antioxidant, an ultraviolet absorber, and a plasticizer.

In an electrophotographic photosensitive member having a multilayer photosensitive layer, a charge transporting layer is formed on a charge generating layer. In the case where the charge transporting layer is the surface layer as shown in FIG. 1A, the charge transporting layer can be formed by forming a coat by the use of a charge transporting layer coating solution that contains the compound represented by the formula (1) dissolved in a solvent and polymerizing (chain-polymerizing) the compound represented by the formula (1) in the coat. In the case where the protective layer is the surface layer as shown in FIG. 1B, the charge transporting layer can be formed by forming a coat by the use of a charge transporting layer coating solution that contains a charge transporting substance and a binder resin dissolved in a solvent and drying the coat.

In the case where the protective layer is the surface layer as shown in FIG. 1B, examples of the charge transporting substance for use in the charge transporting layer include triarylamine compounds, hydrazone compounds, stilbene compounds, pyrazoline compounds, oxazole compounds, thiazole compounds, and triallylmethane compounds.

In the case where the protective layer is the surface layer as shown in FIG. 1B, examples of the binder resin for use in the charge transporting layer include polyvinyl butyral resin, polyarylate resin, polycarbonate resin, polyester resin, phenoxy resin, polyvinyl acetate resin, acrylic resin, polyacrylamide resin, polyamide resin, polyvinylpyridine, cellulose resin, urethane resin, epoxy resin, agarose resin, casein, polyvinyl alcohol resin, and polyvinylpyrrolidone.

In the case where the protective layer is the surface layer as shown in FIG. 1B, the ratio of the charge transporting substance can be 30% or more by mass and 70% or less by mass relative to the total mass of the charge transporting layer.

In the case where the protective layer is the surface layer as shown in FIG. 1B, examples of the solvent for use in the charge transporting layer coating solution include ether solvents, alcohol solvents, ketone solvents, and aromatic hydrocarbon solvents. The thickness of the charge transporting layer can be 5 μm or more and 40 μm or less.

According to an embodiment of the present invention, a protective layer may be formed on the charge transporting layer. The protective layer can be formed by forming a coat by the use of a protective layer coating solution that contains the compound represented by the formula (1) dissolved in a solvent and polymerizing (chain-polymerizing) the compound represented by the formula (1) in the coat.

In the case where the protective layer contains a compound that has a methacryloyloxy group but does not have charge transporting function, the ratio of the compound represented by the formula (1) can be 50% or more by mass and less than 100% by mass relative to the total solid content of the protective layer coating solution.

The thickness of the protective layer can be 2 μm or more and 20 μm or less.

These coating solutions can be applied by, for example, dip coating (dipping), spray coating, spinner coating, bead coating, blade coating, or beam coating.

A polymerization reaction in the formation of the surface layer will be described below. A compound having a chain-polymerizable functional group (methacryloyloxy group) can be polymerized utilizing heat, light (e.g., ultraviolet rays), or radiant rays (e.g., an electron beam). Such a compound can be polymerized utilizing radiant rays, in particular, an electron beam.

Polymerization utilizing an electron beam can produce a three-dimensional network structure having a significantly high density and achieve high electric potential stability. Since the polymerization utilizing an electron beam proceeds efficiently and is completed within a short time, the productivity is high. In the case of irradiation with an electron beam, an accelerator of a scanning type, an electrocurtain type, a broad beam type, a pulse type, or a laminar type may be used.

The irradiation with an electron beam is performed under the following conditions. According to an embodiment of the present invention, when the accelerating voltage of an electron beam is 120 kV or less, the electron beam does not cause a significant deterioration of material properties while the polymerization efficiency is maintained. The electron beam absorbed dose to the surface of an electrophotographic photosensitive member is preferably 5 kGy or more and 50 kGy or less and more preferably 1 kGy or more and 10 kGy or less.

When a compound having a chain-polymerizable functional group according to an embodiment of the present invention is polymerized utilizing an electron beam, irradiation with an electron beam is performed in an inert gas atmosphere and then heating is performed in an inert gas atmosphere in order to prevent oxygen from inhibiting the polymerization. Examples of the inert gas include nitrogen, argon, and helium.

Figure 2:
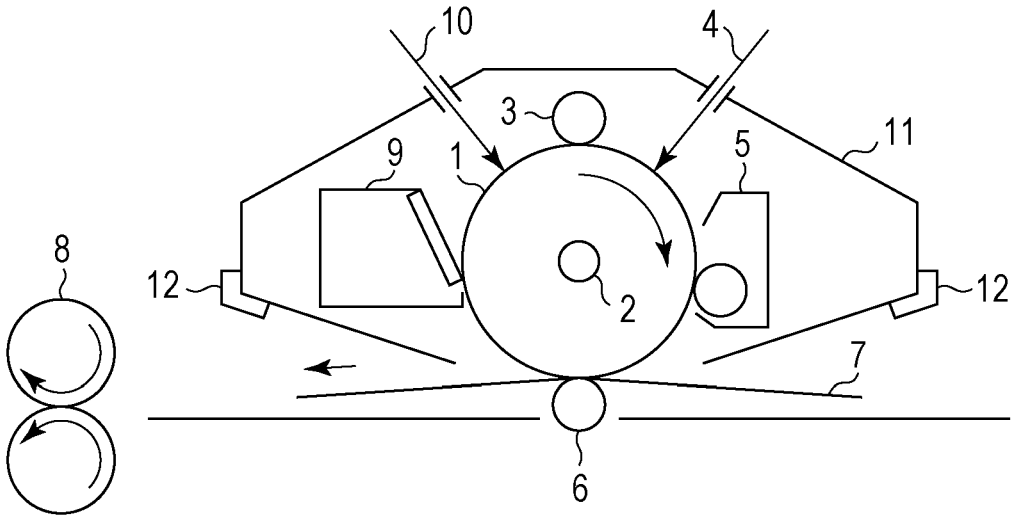
FIG. 2 is a schematic view showing an example of an electrophotographic apparatus that includes a process cartridge including an electrophotographic photosensitive member according to an embodiment of the present invention.

FIG. 2 is a schematic view showing an example of an electrophotographic apparatus that includes a process cartridge including the electrophotographic photosensitive member according to an embodiment of the present invention.

In FIG. 2, a drum-type electrophotographic photosensitive member 1 according to an embodiment of the present invention is rotated around a shaft 2 in the direction indicated by an arrow at a predetermined peripheral speed (process speed). During the rotation, the peripheral surface of the electrophotographic photosensitive member 1 is uniformly positively or negatively charged at a predetermined potential by a charging device (primary charging device) 3. The electrophotographic photosensitive member 1 is then irradiated with intensity-modulated exposure light 4 emitted from an exposure device (not shown) such as a slit exposure device or a laser beam scanning exposure device, in response to the time-series electric digital image signals of intended image information. Thus, electrostatic latent images corresponding to the intended image information are successively formed on the surface of the electrophotographic photosensitive member 1.

The electrostatic latent images are then subjected to normal or reversal development with a toner in a developing device 5 and are made visible as toner images. The toner images formed on the surface of the electrophotographic photosensitive member 1 are successively transferred onto a transfer member 7 by a transferring device 6. The transfer member 7 taken from a paper feeder (not shown) in synchronism with the rotation of the electrophotographic photosensitive member 1 is fed between the electrophotographic photosensitive member 1 and the transferring device 6. A bias voltage having polarity opposite to the polarity of the electric charge of the toner is applied to the transferring device 6 from a bias power supply (not shown). The transferring device may be an intermediate transfer device that includes a primary transfer member, an intermediate transfer member, and a secondary transfer member.

The transfer member 7 onto which toner images have been transferred is then separated from the surface of the electrophotographic photosensitive member 1 and is conveyed to a fixing device 8. After the toner images are fixed, the transfer member 7 is output from the electrophotographic apparatus as an image-formed article (such as a print or a copy).

The surface of the electrophotographic photosensitive member 1 after the toner images have been transferred is cleaned by removing deposits such as residual toner with a cleaning device 9. The residual toner may be recovered with a developing device or the like. If necessary, the electricity is removed with pre-exposure light 10 from a pre-exposure device (not shown), and the electrophotographic photosensitive member 1 is repeatedly used for image forming. In the case where the charging device 3 is a contact charging device such as a charging roller, pre-exposure is not necessarily required.

According to an embodiment of the present invention, a plurality of components selected from the electrophotographic photosensitive member 1, the charging device 3, the developing device 5, the transferring device 6, and the cleaning device 9 may be incorporated in a container to provide a process cartridge. The process cartridge may be detachably attachable to the main body of an electrophotographic apparatus such as a copying machine or a laser-beam printer. For example, at least one device selected from the group consisting of the charging device 3, the developing device 5, the transferring device 6, and the cleaning device 9 may be integrally supported together with the electrophotographic photosensitive member 1 to provide a process cartridge 11, which is detachably attachable to the main body of an electrophotographic apparatus using a guide unit 12 such as a rail of the main body.

EXAMPLES

The present invention will now be further described in detail based on Examples and Comparative Examples. In EXAMPLES, "part" means "part by mass".

Example 1

An aluminum cylinder having a diameter of 30 mm, a length of 357.5 mm, and a thickness of 1 mm was used as a support (electroconductive support).

Next, 50 parts of titanium oxide particles covered with tin oxide containing 10% antimony oxide (trade name: ECT-62, manufactured by Titan Kogyo, Ltd.), 25 parts of resole phenolic resin (trade name: Phenolite J-325 manufactured by Dainippon Ink and Chemicals, Inc., solid content: 70% by mass), 20 parts of methyl cellosolve, 5 parts of methanol, and 0.002 parts of silicone oil (polydimethylsiloxane-polyoxyalkylene copolymer having an average molecular weight of 3000) were dispersed for two hours with a sand mill using glass beads having a diameter of 0.8 mm to prepare an electroconductive layer coating solution.

The electroconductive layer coating solution was applied onto the support by dip coating and dried at 140° C. for 30 minutes to form an electroconductive layer having a thickness of 15 μm.

Subsequently, 2.5 parts of nylon 6-66-610-12 quaterpolymer resin (trade name: CM8000 manufactured by Toray Industries, Inc.) and 7.5 parts of N-methoxymethylated 6 nylon resin (trade name: Toresin EF-30T manufactured by Nagase ChemteX Corporation) were dissolved in a mixed solvent of 100 parts of methanol and 90 parts of butanol to prepare an undercoat layer coating solution.

The undercoat layer coating solution was applied onto the electroconductive layer by dip coating and dried at 100° C. for 10 minutes to form an undercoat layer having a thickness of 0.7 μm.

Subsequently, 11 parts of hydroxy gallium phthalocyanine crystal (charge generating substance) was prepared. The crystal had strong peaks at Bragg angles (2θ±0.2°) of 7.4° and 28.2° in CuKα characteristic X-ray diffraction. Then, 5 parts of polyvinyl butyral resin (trade name: S-LEC BX-1 manufactured by Sekisui Chemical Co., Ltd.) and 130 parts of cyclohexanone were added thereto, and the mixture was dispersed together with 500 parts of glass beads having a diameter of 1 mm at 1800 rpm for two hours while the mixture was cooled with cooling water at 18° C. After the dispersion, the mixture was diluted with 300 parts of ethyl acetate and 160 parts of cyclohexanone to prepare a charge generating layer coating solution.

The average particle size (median) of the hydroxy gallium phthalocyanine crystal in the charge generating layer coating solution was 0.18 μm as measured with a centrifugal particle size analyzer (trade name: CAPA 700) manufactured by Horiba, Ltd., the principle of which is based on liquid phase sedimentation.

The charge generating layer coating solution was applied onto the undercoat layer by dip coating and dried at 110° C. for 10 minutes to form a charge generating layer having a thickness of 0.17 μm.

Next, 5 parts of a compound (charge transporting substance) represented by the following formula (2), 5 parts of a compound (charge transporting substance) represented by the following formula (3), and 10 parts of polycarbonate resin (trade name: Iupilon 2400 manufactured by Mitsubishi Gas Chemical Co., Inc.) were dissolved in a mixed solvent of 70 parts of monochlorobenzene and 30 parts of dimethoxymethane to prepare a charge transporting layer coating solution.

The charge transporting layer coating solution was applied onto the charge generating layer by dip coating and dried at 100° C. for 30 minutes to form a charge transporting layer having a thickness of 18 μm.

(2)

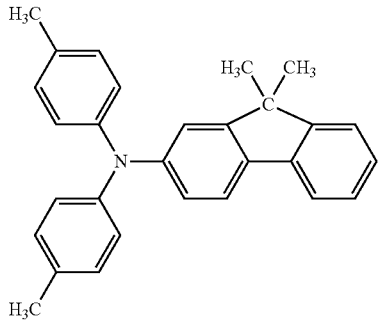

(3)

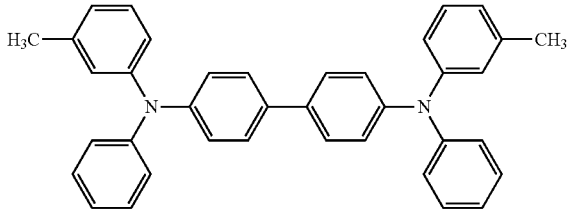

Next, 80 parts of the example compound (1A-1) serving as the compound represented by the formula (1), 20 parts of trimethylolpropane trimethacrylate (trade name: Miramer M301 manufactured by TOYO CHEMICALS CO., LTD.), and 0.005 parts of hydroquinone monomethyl ether (manufactured by TOKYO CHEMICAL INDUSTRY Co., Ltd.) were dissolved in 100 parts of n-propanol. Furthermore, 100 parts of 1,1,2,2,3,3,4-heptafluorocyclopentane (trade name: ZEORORA H manufactured by ZEON CORPORATION) was added to the mixture to prepare a protective layer coating solution.

The protective layer coating solution was applied onto the charge transporting layer by dip coating, and the resulting film was heat-treated at 50° C. for five minutes. The film was then irradiated with an electron beam for 1.6 seconds in a nitrogen atmosphere at an accelerating voltage of 70 kV and an absorbed dose of 50000 Gy. The film was then heat-treated for 30 seconds in a nitrogen atmosphere under the condition that the temperature of the film was 130° C. The processes from the electron beam irradiation to the 30-second heat treatment were performed at an oxygen concentration of 19 ppm. Thus, a protective layer having a thickness of 5 μm was formed.

Accordingly, an electrophotographic photosensitive member was produced. The electrophotographic photosensitive member included the support, the electroconductive layer, the undercoat layer, the charge generating layer, the charge transporting layer, and the protective layer. The protective layer was the surface layer.

Examples 2 to 5 and 7 to 9

An electrophotographic photosensitive member was produced in the same manner as in Example 1, except that the protective layer coating solution was prepared using an example compound listed in Table 1 as the compound represented by the formula (1).

Example 6

An electrophotographic photosensitive member was produced in the same manner as in Example 1, except that the protective layer coating solution was prepared using a mixture of 40 parts of the example compound (1A-1) and 40 parts of the example compound (1A-2) as the compound represented by the formula (1).

Examples 10 and 11

An electrophotographic photosensitive member was produced in the same manner as in Example 1, except that the protective layer coating solution was prepared using an example compound listed in Table 1 as the compound represented by the formula (1) without using trimethylolpropane trimethacrylate.

Examples 12 and 13

An electrophotographic photosensitive member was produced in the same manner as in Example 1, except that the protective layer coating solution was prepared using trimethylolpropane triacrylate (trade name: Miramer M300, manufactured by TOYO CHEMICALS CO., LTD.) instead of trimethylolpropane trimethacrylate and using an example compound listed in Table 1 as the compound represented by the formula (1).

Examples 14 and 15

An electrophotographic photosensitive member was produced in the same manner as in Example 1, except that the protective layer coating solution was prepared using a compound represented by formula (A-1) below instead of trimethylolpropane trimethacrylate and using an example compound listed in Table 1 as the compound represented by the formula (1).

(A-1)

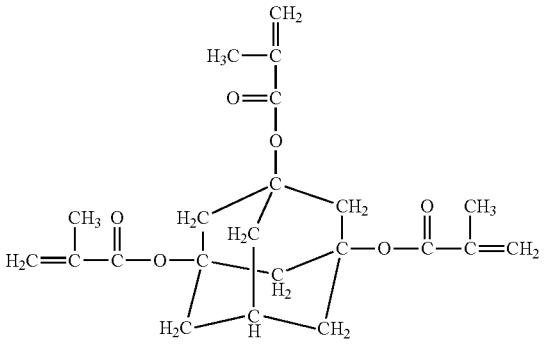

Example 16

An electrophotographic photosensitive member was produced in the same manner as in Example 1, except that the protective layer coating solution was prepared using a compound represented by formula (A-2) below instead of trimethylolpropane trimethacrylate and using an example compound listed in Table 1 as the compound represented by the formula (1).

(A-2)

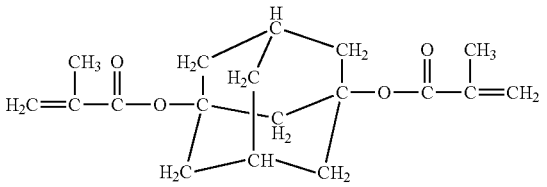

Example 17

An electrophotographic photosensitive member was produced in the same manner as in Example 16, except that the protective layer coating solution was prepared by changing the amount of the example compound (1A-1) from 80 parts to 60 parts and changing the amount of the compound represented by the formula (A-2) from 20 parts to 40 parts.

Example 18

An electrophotographic photosensitive member was produced in the same manner as in Example 16, except that the protective layer coating solution was prepared by changing the amount of the example compound (1A-1) from 80 parts to 40 parts and changing the amount of the compound represented by the formula (A-2) from 20 parts to 60 parts.

Example 19

An electrophotographic photosensitive member was produced in the same manner as in Example 16, except that the protective layer coating solution was prepared using an example compound listed in Table 1 as the compound represented by the formula (1).

Examples 20 and 21

An electrophotographic photosensitive member was produced in the same manner as in Example 1, except that the protective layer coating solution was prepared using a compound represented by formula (B-1) below instead of trimethylolpropane trimethacrylate and using an example compound listed in Table 1 as the compound represented by the formula (1).

(B-1)

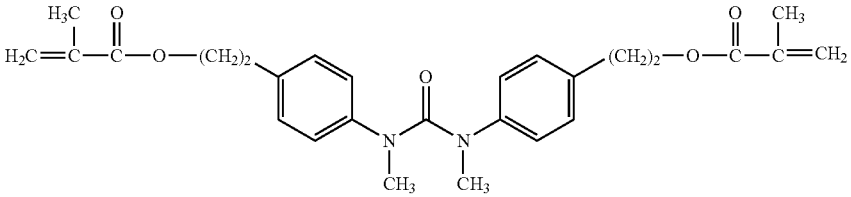

Examples 22 and 23

An electrophotographic photosensitive member was produced in the same manner as in Example 1, except that the protective layer coating solution was prepared using a compound represented by formula (C-1) below instead of trimethylolpropane trimethacrylate and using an example compound listed in Table 1 as the compound represented by the formula (1).

(C-1)

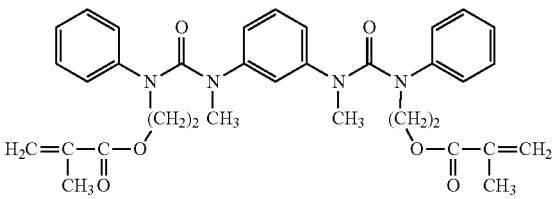

Example 24

An electrophotographic photosensitive member was produced in the same manner as in Example 1, except that the protective layer coating solution was prepared by changing the amount of the example compound (1A-1) from 80 parts to 75 parts and adding 5 parts of a compound represented by formula (D-1) below.

(D-1)

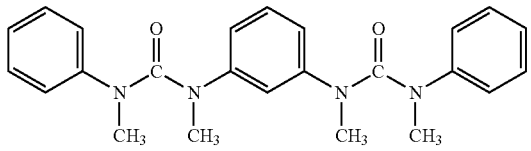

Example 25

An electrophotographic photosensitive member was produced in the same manner as in Example 24, except that the protective layer coating solution was prepared using an example compound listed in Table 1 as the compound represented by the formula (1).

Example 26

An electrophotographic photosensitive member was produced in the same manner as in Example 1 except for the following. The protective layer coating solution in Example 1 was changed to a protective layer coating solution prepared by dissolving 80 parts of the example compound (1A-1), 20 parts of trimethylolpropane trimethacrylate (trade name: Miramer M301 manufactured by TOYO CHEMICALS CO., LTD.), 0.005 parts of hydroquinone monomethyl ether (manufactured by TOKYO CHEMICAL INDUSTRY Co., Ltd.), and 1 part of 1-hydroxycyclohexyl phenyl ketone (trade name: Irgacure 184 manufactured by Ciba Specialty Chemicals) in 100 parts of n-propanol and furthermore adding 100 parts of 1,1,2,2,3,3,4-heptafluorocyclopentane (trade name: ZEORORA H manufactured by ZEON CORPORATION) thereto. The protective layer coating solution was applied onto the charge transporting layer by dip coating, and the resulting film was heat-treated at 50° C. for five minutes, irradiated with light from a metal halide lamp for 20 seconds at an irradiation intensity of 500 mW/cm$^2$, and then heat-treated for 30 minutes under the condition that the temperature of the film was 130° C. to form a protective layer having a thickness of 5 μm.

Example 27

An electrophotographic photosensitive member was produced in the same manner as in Example 26, except that the protective layer coating solution was prepared using an example compound listed in Table 1 as the compound represented by the formula (1).

Example 28

An electrophotographic photosensitive member was produced in the same manner as in Example 1, except that the protective layer was formed by performing irradiation with an electron beam for 1.6 seconds in a nitrogen atmosphere at an accelerating voltage of 50 kV and an absorbed dose of 5000 Gy.

Example 29

An electrophotographic photosensitive member was produced in the same manner as in Example 28, except that the protective layer coating solution was prepared using an example compound listed in Table 1 as the compound represented by the formula (1).

Example 30

In Example 1, the protective layer was not formed and the charge transporting layer coating solution was changed to a charge transporting layer coating solution prepared by dissolving 80 parts of the example compound (1A-1), 20 parts of trimethylolpropane trimethacrylate (trade name: Miramer M301 manufactured by TOYO CHEMICALS CO., LTD.), and 0.005 parts of hydroquinone monomethyl ether (manufactured by TOKYO CHEMICAL INDUSTRY Co., Ltd.) in 100 parts of n-propanol and furthermore adding 100 parts of 1,1,2,2,3,3,4-heptafluorocyclopentane (trade name: ZEORORA H manufactured by ZEON CORPORATION) thereto. The charge transporting layer coating solution was applied onto the charge generating layer by dip coating, and the resulting film was heat-treated at 50° C. for five minutes. The film was then irradiated with an electron beam for 1.6 seconds in a nitrogen atmosphere at an accelerating voltage of 70 kV and an absorbed dose of 50000 Gy. The film was then heat-treated for 30 seconds in a nitrogen atmosphere under the condition that the temperature of the film was 130° C. The processes from the electron beam irradiation to the 30-second heat treatment were performed at an oxygen concentration of 19 ppm. Thus, a charge transporting layer having a thickness of 10 μm was formed. Accordingly, an electrophotographic photosensitive member which included the support, the electroconductive layer, the undercoat layer, the charge generating layer, and the charge transporting layer and in which the charge transporting layer was the surface layer was produced.

Example 31

An electrophotographic photosensitive member was produced in the same manner as in Example 30, except that the charge transporting layer coating solution was prepared using an example compound listed in Table 1 as the compound represented by the formula (1).

Examples 32 and 33

An electrophotographic photosensitive member was produced in the same manner as in Example 1, except that the protective layer coating solution was prepared using an example compound listed in Table 1 as the compound represented by the formula (1) without using hydroquinone monomethyl ether.

Example 34

An electrophotographic photosensitive member was produced in the same manner as in Example 1, except that the protective layer coating solution was prepared by changing the amount of hydroquinone monomethyl ether from 0.005 parts to 0.15 parts.

COMPARATIVE EXAMPLES

The following comparative compounds (R-1) to (R-15) were used as comparative compounds of the compound represented by the formula (1).

(R-1)
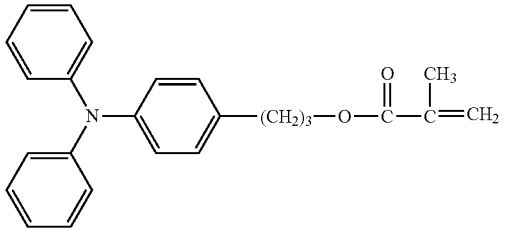
(R-2)
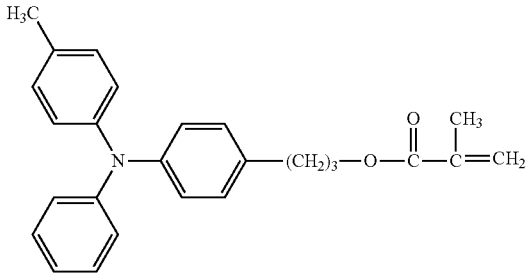
(R-3)
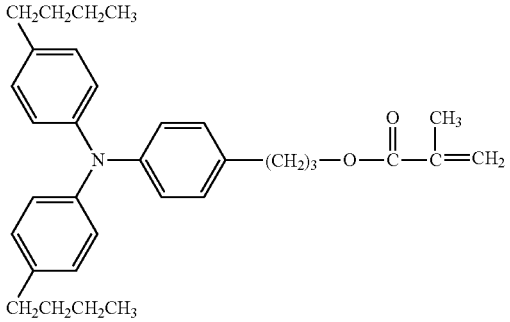
(R-4)
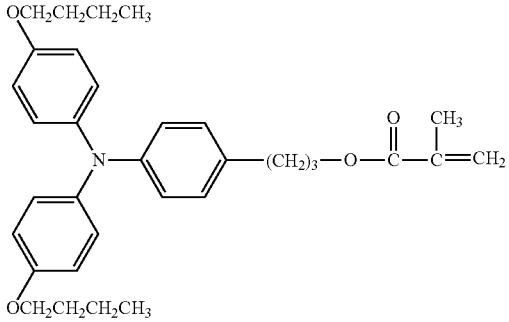
(R-5)
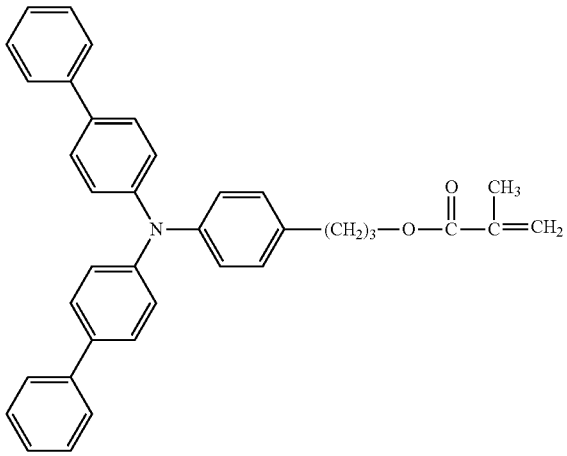
(R-6)
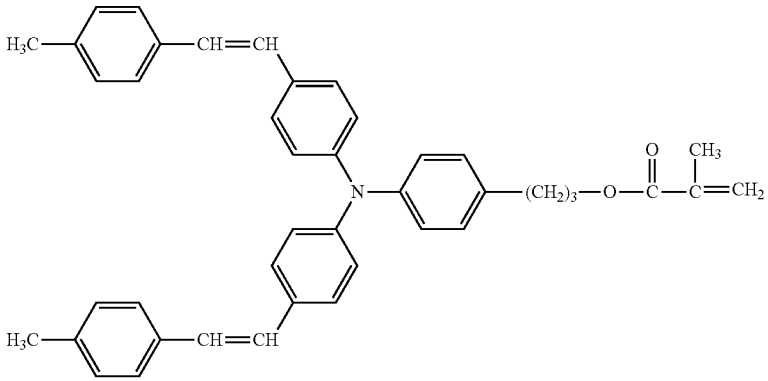

-continued
(R-7)
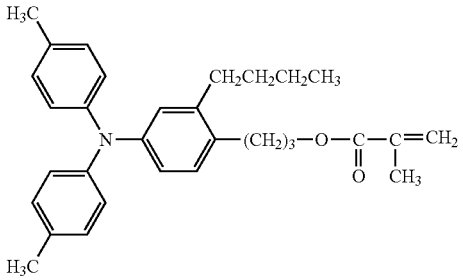
(R-8)
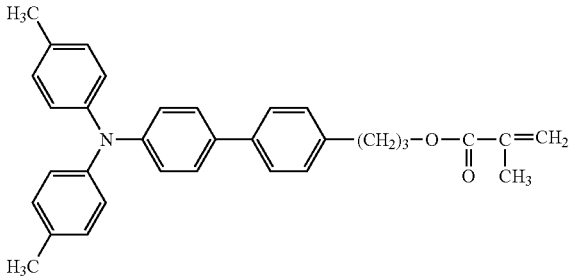
(R-9)
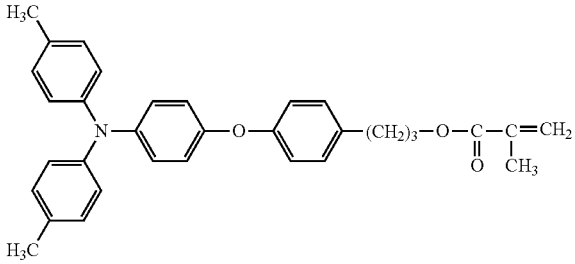
(R-10)
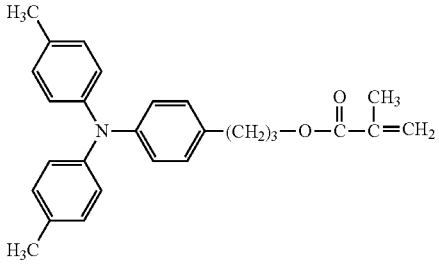
(R-11)
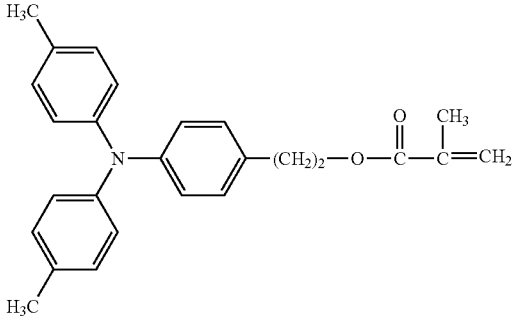
(R-12)
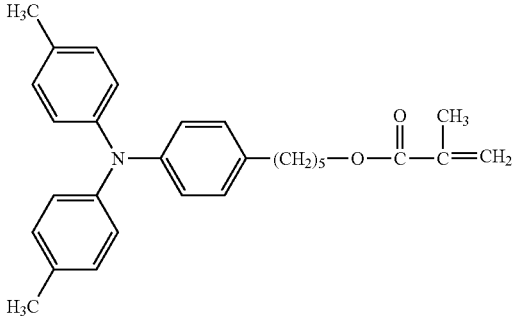
(R-13)
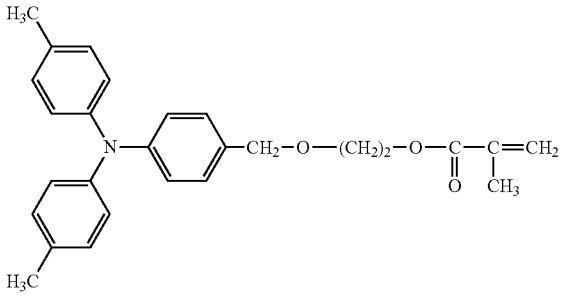
(R-14)
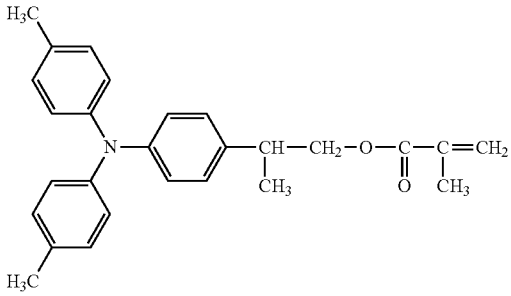
(R-15)
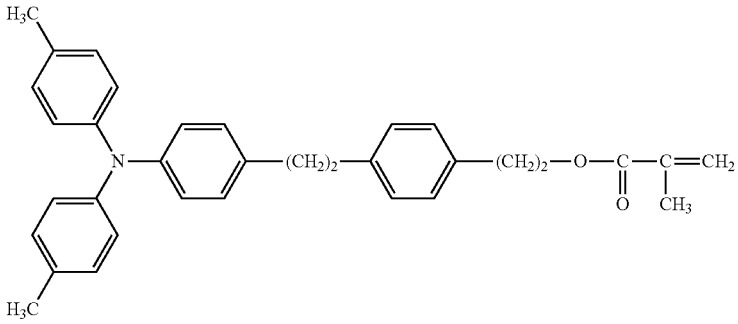

Comparative Examples 1 to 15

An electrophotographic photosensitive member was produced in the same manner as in Example 1, except that the protective layer coating solution was prepared using a comparative compound listed in Table 1 as the compound represented by the formula (1) without using hydroquinone monomethyl ether.

Comparative Examples 16 and 17

An electrophotographic photosensitive member was produced in the same manner as in Example 10, except that the protective layer coating solution was prepared using a comparative compound listed in Table 1 as the compound represented by the formula (1) without using hydroquinone monomethyl ether.

Comparative Examples 18 and 19

An electrophotographic photosensitive member was produced in the same manner as in Example 12, except that the protective layer coating solution was prepared using a comparative compound listed in Table 1 as the compound represented by the formula (1) without using hydroquinone monomethyl ether.

Comparative Examples 20 and 21

An electrophotographic photosensitive member was produced in the same manner as in Example 14, except that the protective layer coating solution was prepared using a comparative compound listed in Table 1 as the compound represented by the formula (1) without using hydroquinone monomethyl ether.

Comparative Examples 22 and 23

An electrophotographic photosensitive member was produced in the same manner as in Example 16, except that the protective layer coating solution was prepared using a comparative compound listed in Table 1 as the compound represented by the formula (1) without using hydroquinone monomethyl ether.

Comparative Examples 24 and 25

An electrophotographic photosensitive member was produced in the same manner as in Example 20, except that the protective layer coating solution was prepared using a comparative compound listed in Table 1 as the compound represented by the formula (1) without using hydroquinone monomethyl ether.

Comparative Examples 26 and 27

An electrophotographic photosensitive member was produced in the same manner as in Example 32, except that the protective layer coating solution was prepared using a comparative compound listed in Table 1 as the compound represented by the formula (1).

Comparative Examples 28 and 29

An electrophotographic photosensitive member was produced in the same manner as in Example 30, except that the charge transporting layer coating solution was prepared using a comparative compound listed in Table 1 as the compound represented by the formula (1) without using hydroquinone monomethyl ether.

TABLE 1

| Example | Example compound | Comparative Example | Comparative compound |
|---|---|---|---|
| Example 1 | 1A-1 | Comparative Example 1 | R-1 |
| Example 2 | 1A-2 | Comparative Example 2 | R-2 |
| Example 3 | 1A-4 | Comparative Example 3 | R-3 |
| Example 4 | 1A-5 | Comparative Example 4 | R-4 |
| Example 5 | 1A-7 | Comparative Example 5 | R-5 |
| Example 6 | 1A-1/1A-2 | Comparative Example 6 | R-6 |
| Example 7 | 1A-8 | Comparative Example 7 | R-7 |
| Example 8 | 1A-12 | Comparative Example 8 | R-8 |
| Example 9 | 1B-1 | Comparative Example 9 | R-9 |
| Example 10 | 1A-1 | Comparative Example 10 | R-10 |
| Example 11 | 1A-2 | Comparative Example 11 | R-11 |
| Example 12 | 1A-1 | Comparative Example 12 | R-12 |
| Example 13 | 1A-2 | Comparative Example 13 | R-13 |
| Example 14 | 1A-1 | Comparative Example 14 | R-14 |
| Example 15 | 1A-2 | Comparative Example 15 | R-15 |
| Example 16 | 1A-1 | Comparative Example 16 | R-11 |
| Example 17 | 1A-1 | Comparative Example 17 | R-12 |
| Example 18 | 1A-1 | Comparative Example 18 | R-11 |
| Example 19 | 1A-2 | Comparative Example 19 | R-12 |
| Example 20 | 1A-1 | Comparative Example 20 | R-11 |
| Example 21 | 1A-2 | Comparative Example 21 | R-12 |
| Example 22 | 1A-1 | Comparative Example 22 | R-11 |
| Example 23 | 1A-2 | Comparative Example 23 | R-12 |
| Example 24 | 1A-1 | Comparative Example 24 | R-11 |
| Example 25 | 1A-2 | Comparative Example 25 | R-12 |
| Example 26 | 1A-1 | Comparative Example 26 | R-11 |
| Example 27 | 1A-2 | Comparative Example 27 | R-12 |
| Example 28 | 1A-1 | Comparative Example 28 | R-11 |
| Example 29 | 1A-2 | Comparative Example 29 | R-12 |
| Example 30 | 1A-1 | | |
| Example 31 | 1A-2 | | |
| Example 32 | 1A-1 | | |
| Example 33 | 1A-2 | | |
| Example 34 | 1A-1 | | |

Evaluation of Electrophotographic Photosensitive Member

The electrophotographic photosensitive members of Examples 1 to 34 and Comparative Examples 1 to 29 were evaluated as follows.

The percentage of a residual chain-polymerizable functional group was determined as follows.

A portion of a surface layer 179 mm away from one end of each of the produced electrophotographic photosensitive members was removed with a razor. The portion of the surface layer was subjected to a Fourier transform infrared attenuated total reflection spectroscopic study to determine the IR peak ratio of a residual chain-polymerizable functional group (methacryloyloxy group or acryloyloxy group) that was not involved in the polymerization reaction. Spectrum One FT-IR Spectrometer manufactured by Perkin Elmer Instruments was used as a Fourier transform infrared spectrophotometer. The peak area assigned to the in-plane bending vibration of a terminal olefin ($CH_2$=) of the methacryloyloxy group was determined at wave numbers of 1394 $cm^{-1}$ or more and 1413 $cm^{-1}$ or less. The peak area assigned to the stretching vibration of carbonyl (C=O) of the methacryloyloxy group was determined at wave numbers of 1689 $cm^{-1}$ or more and 1759 $cm^{-1}$ or less. The ratio of the peak area of the olefin to the peak area of the carbonyl was calculated as the IR peak ratio of the residual chain-polymerizable functional group. The peak area assigned to the in-plane bending vibration of a terminal olefin ($CH_2$=) of the acryloyloxy group was determined at wave numbers of 1400 $cm^{-1}$ or more and 1413 $cm^{-1}$ or less. The peak area assigned to the stretching vibration of carbonyl (C=O) of the acryloyloxy group was determined at wave numbers of 1699 $cm^{-1}$ or more and 1769 $cm^{-1}$ or less. The ratio of the peak area of the olefin to the peak area of the carbonyl was calculated as the IR peak ratio of the residual chain-polymerizable functional group. Tables 2 and 3 show the results.

The residual potential of the electrophotographic photosensitive member was evaluated as follows.

Each of the produced electrophotographic photosensitive members was attached to a drum test machine CYNTHIA 59 manufactured by Gen-Tech, Inc. The initial residual potential and the residual potential after 1000 revolutions of the electrophotographic photosensitive member were measured. The surface of the electrophotographic photosensitive member was charged with a scorotron corona charger. The primary current was set at 150 μA. The grid voltage was set such that the voltage applied to the surface of the electrophotographic photosensitive member was −750 V. A halogen lamp was used as a pre-exposure light source. The wavelength of pre-exposure light was determined using a 676-nm interference filter such that the light amount of the pre-exposure light was five times the light amount in which the light area potential was −200 V. The rotation speed was 0.20 seconds per revolution. The evaluation was performed at a temperature of 30° C. and a humidity of 80%. Tables 2 and 3 show the results.

TABLE 2

| | Percentage of residual chain-polymerizable functional group | Evaluation of residual potential of photosensitive member | |
|---|---|---|---|
| | | Initial residual potential | Residual potential after 1000 revolutions |
| Example 1 | 0.003 | 15 | 65 |
| Example 2 | 0.003 | 15 | 65 |
| Example 3 | 0.003 | 15 | 65 |
| Example 4 | 0.003 | 15 | 65 |
| Example 5 | 0.003 | 15 | 65 |
| Example 6 | 0.003 | 15 | 65 |
| Example 7 | 0.003 | 15 | 65 |
| Example 8 | 0.003 | 15 | 65 |
| Example 9 | 0.005 | 20 | 70 |
| Example 10 | 0.008 | 15 | 70 |
| Example 11 | 0.008 | 15 | 70 |
| Example 12 | 0.010 | 20 | 70 |
| Example 13 | 0.010 | 20 | 70 |
| Example 14 | 0.002 | 15 | 60 |
| Example 15 | 0.002 | 15 | 60 |
| Example 16 | 0.002 | 10 | 60 |
| Example 17 | 0.002 | 10 | 60 |
| Example 18 | 0.002 | 15 | 65 |
| Example 19 | 0.002 | 10 | 60 |
| Example 20 | 0.003 | 15 | 50 |
| Example 21 | 0.003 | 15 | 50 |
| Example 22 | 0.003 | 15 | 50 |
| Example 23 | 0.003 | 15 | 50 |
| Example 24 | 0.002 | 15 | 50 |
| Example 25 | 0.002 | 15 | 50 |
| Example 26 | 0.010 | 25 | 75 |
| Example 27 | 0.010 | 25 | 75 |
| Example 28 | 0.002 | 7 | 57 |
| Example 29 | 0.002 | 7 | 57 |
| Example 30 | 0.008 | 25 | 75 |
| Example 31 | 0.008 | 25 | 75 |
| Example 32 | 0.002 | 20 | 70 |
| Example 33 | 0.002 | 20 | 70 |
| Example 34 | 0.006 | 35 | 85 |

TABLE 3

| | Percentage of residual chain-polymerizable functional group | Evaluation of residual potential of photosensitive member | |
|---|---|---|---|
| | | Initial residual potential | Residual potential after 1000 revolutions |
| Comparative Example 1 | 0.003 | 60 | 120 |
| Comparative Example 2 | 0.003 | 55 | 120 |
| Comparative Example 3 | 0.020 | 70 | 135 |
| Comparative Example 4 | 0.020 | 70 | 135 |
| Comparative Example 5 | 0.017 | 75 | 140 |
| Comparative Example 6 | 0.020 | 80 | 145 |
| Comparative Example 7 | 0.020 | 70 | 135 |
| Comparative Example 8 | 0.015 | 65 | 130 |
| Comparative Example 9 | 0.015 | 65 | 130 |
| Comparative Example 10 | 0.020 | 60 | 125 |
| Comparative Example 11 | 0.020 | 65 | 125 |
| Comparative Example 12 | 0.012 | 60 | 120 |
| Comparative Example 13 | 0.010 | 55 | 135 |
| Comparative Example 14 | 0.028 | 75 | 135 |
| Comparative Example 15 | 0.030 | 75 | 135 |
| Comparative Example 16 | 0.023 | 65 | 130 |
| Comparative Example 17 | 0.015 | 60 | 125 |
| Comparative Example 18 | 0.025 | 70 | 130 |
| Comparative Example 19 | 0.018 | 65 | 125 |
| Comparative Example 20 | 0.018 | 65 | 120 |
| Comparative Example 21 | 0.010 | 60 | 115 |
| Comparative Example 22 | 0.018 | 60 | 120 |
| Comparative Example 23 | 0.010 | 55 | 115 |
| Comparative Example 24 | 0.020 | 65 | 110 |
| Comparative Example 25 | 0.012 | 60 | 105 |
| Comparative Example 26 | 0.020 | 75 | 135 |
| Comparative Example 27 | 0.012 | 70 | 130 |
| Comparative Example 28 | 0.018 | 80 | 140 |
| Comparative Example 29 | 0.011 | 75 | 135 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-262125 filed Nov. 30, 2011 and No. 2012-244528 filed Nov. 6, 2012, which are hereby incorporated by reference herein in their entirety.

What is claimed is:

1. An electrophotographic photosensitive member, comprising:

a support; and a photosensitive layer formed on the support, wherein a surface layer of the electrophotographic photosensitive member comprises a polymer obtained by polymerization of a composition comprising:

a compound represented by the following formula (1); and a compound represented by formula (A);

(1)

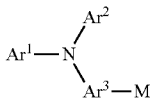

(M)

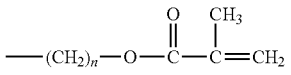

wherein, in the formula (1), $Ar^1$ and $Ar^2$ each independently represents a substituted phenyl group, $Ar^3$ represents an unsubstituted or substituted phenylene group, M is a group represented by formula (M) above and, in the formula (M), n represents 3 or 4, and a substituent group of the substituted phenyl group and a substituent group of the substituted phenylene group are each independently an unsubstituted methyl group, an unsubstituted ethyl group, an unsubstituted n-propyl group, an unsubstituted methoxy group, an unsubstituted ethoxy group, or an unsubstituted propoxy group, (A)

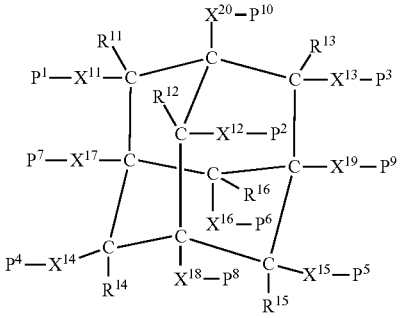

wherein in the formula (A), $R^{11}$ to $R^{16}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, or a bromine atom, $X^{11}$ to $X^{20}$ each independently represents a single bond or an alkylene group, $P^1$ to $P^{10}$ each independently represents a hydrogen atom, a methyl group, an ethyl group, a n-propyl group, a trifluoromethyl group, a hydroxy group, a methoxy group, an ethoxy group, an amino group, a dimethylamino group, a trimethylsilyl group, a fluorine atom, a chlorine atom, a bromine atom, or a methacryloyloxy group, at least two of $P^1$ to $P^{10}$ are a methacryloyloxy group, however, when $X^{11}$ is a single bond, $P^1$ and $R^{11}$ may combine to form an oxo group (=O), when $X^{12}$ is a single bond, $P^2$ and $R^{12}$ may combine to form an oxo group (=O), when $X^{13}$ is a single bond, $P^3$ and $R^{13}$ may combine to form an oxo group (=O), when $X^{14}$ is a single bond, $P^4$ and $R^{14}$ may combine to form an oxo group (=O), when $X^{15}$ is a single bond, $P^5$ and $R^{15}$ may combine to form an oxo group (=O), and, when $X^{16}$ is a single bond, $P^6$ and $R^{16}$ may combine to form an oxo group (=O), and $R^{11}$ is a hydrogen atom when $P^1$ is a methacryloyloxy group, $R^{12}$ is a hydrogen atom when $P^2$ is a methacryloyloxy group, $R^{13}$ is a hydrogen atom when $P^3$ is a methacryloyloxy group, $R^{14}$ is a hydrogen atom when $P^4$ is a methacryloyloxy group, $R^{15}$ is a hydrogen atom when $P^5$ is a methacryloyloxy group, and $R^{16}$ is a hydrogen atom when $P^6$ is a methacryloyloxy group, and wherein the surface layer further comprises a quinone derivative, the quinone derivative being at least one compound selected from the group consisting of:

a compound represented by the following formula (G), and a compound represented by the following formula (H), wherein the content of the quinone derivative in the surface layer is not less than 5 ppm and not more than 1500 ppm relative to the total mass of the polymer;

(G)

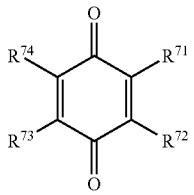

(H)

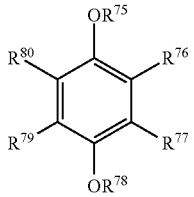

wherein, in the formulae (G) and (H), $R^{71}$ to $R^{74}$, $R^{76}$, $R^{77}$, $R^{79}$, and $R^{80}$ each independently represents a hydrogen atom, a hydroxy group, an unsubstituted or substituted alkyl group, an unsubstituted or substituted aryl group, or an unsubstituted or substituted alkoxy group, at least one of $R^{71}$ and $R^{74}$ is a hydrogen atom, a methyl group, or a hydroxy group, at least one of $R^{72}$ and $R^{73}$ is a hydrogen atom, a methyl group, or a hydroxy group, at least one of $R^{76}$ and $R^{80}$ is a hydrogen atom, a methyl group, or a hydroxy group, at least one of $R^{77}$ and $R^{79}$ is a hydrogen atom, a methyl group, or a hydroxy group, $R^{75}$ and $R^{78}$ each independently represents a hydrogen atom, an unsubstituted or substituted alkyl group, or an unsubstituted or substituted aryl group, and at least one of $R^{75}$ and $R^{78}$ is a hydrogen atom.

2. The electrophotographic photosensitive member according to claim 1, wherein the surface layer further comprises at least one compound selected from the group consisting of a compound represented by the following formula (D), a compound represented by the following formula (E), and a compound represented by the following formula (F); and (D)

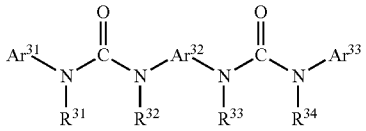

(E)

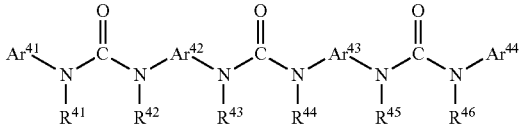

-continued (F)

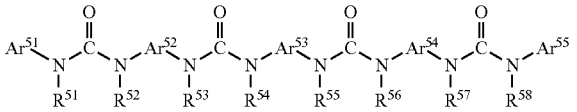

wherein, in the formulae (D), (E) and (F), $R^{31}$ to $R^{34}$, $R^{41}$ to $R^{46}$, and $R^{51}$ to $R^{58}$ each independently represents an alkyl group, $Ar^{32}$, $Ar^{42}$ and $Ar^{43}$, and $Ar^{52}$ to $Ar^{54}$ each independently represents an unsubstituted or substituted arylene group, $Ar^{31}$, $Ar^{33}$, $Ar^{41}$, $Ar^{44}$, $Ar^{51}$, and $Ar^{55}$ each independently represents an unsubstituted or substituted aryl group or a condensed ring, a substituent group of the substituted arylene group is an alkyl group, an alkoxy-substituted alkyl group, a halogen-substituted alkyl group, an alkoxy group, an alkoxy-substituted alkoxy group, a halogen-substituted alkoxy group, or a halogen atom, and a substituent group of the substituted aryl group is a carboxyl group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

3. A method of producing the electrophotographic photosensitive member according to claim 1, wherein the method comprises the following steps of:

forming a coat for the surface layer by using a surface layer coating solution comprising the compound represented by the formula (1), the compound represented by formula (A) and the quinone derivative, and forming the surface layer by polymerization of the compound represented by the formula (1) and the composition represented by formula (A) in the coat.

4. The method according to claim 3, wherein the polymerization of the compound represented by the formula (1) and the compound represented by formula (A) is effected by irradiating the coat with an electron beam.

5. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

6. An electrophotographic apparatus comprising:

the electrophotographic photosensitive member according to claim 1;

a charging device;

an exposure device;

a developing device; and a transferring device.

7. An electrophotographic photosensitive member, comprising:

a support; and a photosensitive layer formed on the support, wherein a surface layer of the electrophotographic photosensitive member comprises a polymer obtained by polymerization of a composition comprising:

a compound represented by the following formula (1); and at least one compound selected from the group consisting of a compound represented by the following formula (B) and a compound represented by the following formula (C); and (1)

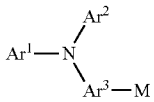

(M)

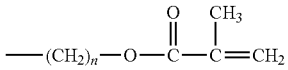

wherein, in the formula (1), $Ar^1$ and $Ar^2$ each independently represents a substituted phenyl group, $Ar^3$ represents an unsubstituted or substituted phenylene group, M is a group represented by formula (M) above and, in the formula (M), n represents 3 or 4, and a substituent group of the substituted phenyl group and a substituent group of the substituted phenylene group are each independently an unsubstituted methyl group, an unsubstituted ethyl group, an unsubstituted n-propyl group, an unsubstituted methoxy group, an unsubstituted ethoxy group, or an unsubstituted propoxy group, (B)

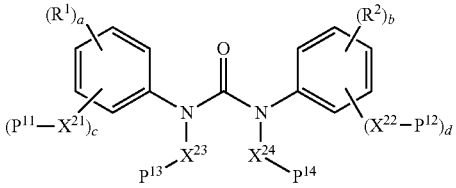

(C)

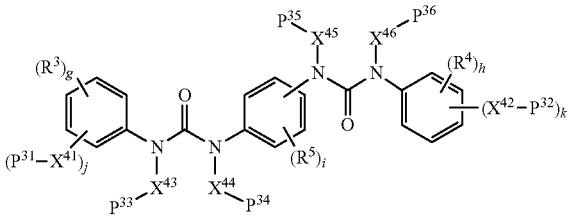

wherein, in the formulae (B) and (C), $R^1$ to $R^5$ each independently represents a methyl group, an ethyl group, a n-propyl group, a methoxymethyl group, a trifluoromethyl group, a trichloromethyl group, a methoxy group, an ethoxy group, a propoxy group, a methoxymethoxy group, a trifluoromethoxy group, a trichloromethoxy group, a dimethylamimo group, or a fluorine atom, $X^{21}$ to $X^{24}$ and $X^{41}$ to $X^{46}$ each independently represents an alkylene group, $P^{11}$ to $P^{14}$ and $P^{31}$ to $P^{36}$ each independently represents a hydrogen atom or a methacryloyloxy group, at least two of $P^{11}$ to $P^{14}$ are methacryloyloxy groups, at least two of $P^{31}$ to $P^{36}$ are methacryloyloxy groups, a, b, g, and h each independently represents an integer number selected from 0 to 5, i represents an integer number selected from 0 to 4, c, d, j, and k each independently represents 0 or 1, and wherein the surface layer further comprises a quinone derivative, the quinone derivative being at least one compound selected from the group consisting of:

a compound represented by the following formula (G), and hydroquinone monomethyl ether, wherein the content of the quinone derivative in the surface layer is not less than 5 ppm and not more than 1500 ppm relative to the total mass of the polymer; and (G)

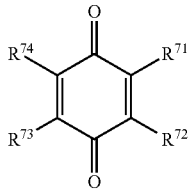

wherein, in the formula (G), $R^{71}$ to $R^{74}$ each independently represents a hydrogen atom, a hydroxy group, an unsubstituted or substituted alkyl group, an unsubstituted or substituted aryl group, or an unsubstituted or substituted alkoxy group, at least one of $R^{71}$ and $R^{74}$ is a hydrogen atom, a methyl group, or a hydroxy group, at least one of $R^{72}$ and $R^{73}$ is a hydrogen atom, a methyl group, or a hydroxy group.

8. The electrophotographic photosensitive member according to claim 7, wherein the surface layer further comprises at least one compound selected from the group consisting of a compound represented by the following formula (D), a compound represented by the following formula (E), and a compound represented by the following formula (F); and (D)

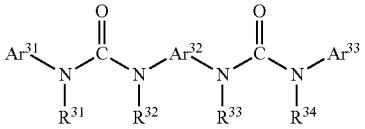

(E)

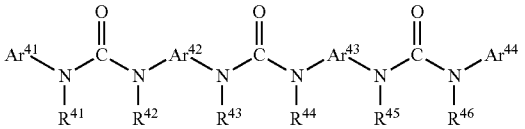

-continued (F)

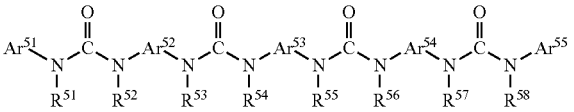

wherein, in the formulae (D), (E) and (F), $R^{31}$ to $R^{34}$, $R^{41}$ to $R^{46}$, and $R^{51}$ to $R^{58}$ each independently represents an alkyl group, $Ar^{32}$, $Ar^{42}$ and $Ar^{43}$, and $Ar^{52}$ to $Ar^{54}$ each independently represents an unsubstituted or substituted arylene group, $Ar^{31}$, $Ar^{33}$, $Ar^{41}$, $Ar^{44}$, $Ar^{51}$, and $Ar^{55}$ each independently represents an unsubstituted or substituted aryl group or a condensed ring, a substituent group of the substituted arylene group is an alkyl group, an alkoxy-substituted alkyl group, a halogen-substituted alkyl group, an alkoxy group, an alkoxy-substituted alkoxy group, a halogen-substituted alkoxy group, or a halogen atom, and a substituent group of the substituted aryl group is a carboxyl group, a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

9. A method of producing the electrophotographic photosensitive member according to claim 7, wherein the method comprises the following steps of:

forming a coat for the surface layer by using a surface layer coating solution comprising:

the compound represented by the formula (1);

at least one compound selected from the group consisting of the compound represented by the formula (B) and the compound represented by the formula (C); and the quinone derivative, and forming the surface layer by polymerization of the compound represented by the formula (1) and at least one compound selected from the group consisting of the compound represented by the formula (B) and the compound represented by the formula (C) in the coat.

10. A process cartridge detachably attachable to a main body of an electrophotographic apparatus, wherein the process cartridge integrally supports:

the electrophotographic photosensitive member according to claim 7, and at least one device selected from the group consisting of a charging device, a developing device, a transferring device, and a cleaning device.

11. An electrophotographic apparatus comprising:

the electrophotographic photosensitive member according to claim 7;

a charging device;

an exposure device;

a developing device; and a transferring device.

* * * * *